US006574831B2

(12) United States Patent
Hunter et al.

(10) Patent No.: US 6,574,831 B2
(45) Date of Patent: Jun. 10, 2003

(54) UPRIGHT VACUUM CLEANER HAVING DETACHABLE UPRIGHT HANDLE

(75) Inventors: Murray D. Hunter, Kingston (CA); Oleksiy P. Sergyeyenko, Brockville (CA); Corey D. MacTavish, Brockville (CA); David M. Shaver, Brockville (CA); Jacob R. Prosper, Brockville (CA)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/886,963

(22) Filed: Jun. 21, 2001

(65) Prior Publication Data

US 2002/0194699 A1 Dec. 26, 2002

(51) Int. Cl.[7] ..... A47L 9/32

(52) U.S. Cl. ..... 15/410; 15/323; 15/329; 15/344

(58) Field of Search ..... 15/328, 410

(56) References Cited

U.S. PATENT DOCUMENTS

| | | | | |
|---|---|---|---|---|
| 1,676,058 A | | 7/1928 | Smellie | |
| 1,918,519 A | * | 7/1933 | Clements | 15/144.4 |
| 2,842,788 A | * | 7/1958 | Rench et al. | 15/23 |
| 3,608,333 A | | 9/1971 | Selley et al. | |
| 3,621,511 A | | 11/1971 | Selley et al. | |
| 3,897,607 A | | 8/1975 | Schaffer et al. | |
| 4,715,084 A | * | 12/1987 | Jacob et al. | 15/328 |
| 4,947,512 A | | 8/1990 | Lackner et al. | |
| 5,007,133 A | | 4/1991 | Lackner et al. | |
| 5,086,536 A | | 2/1992 | Lackner et al. | |
| 5,664,285 A | | 9/1997 | Melito et al. | |
| 5,671,499 A | | 9/1997 | Melito et al. | |
| 5,699,586 A | | 12/1997 | Melito et al. | |
| 6,012,200 A | | 1/2000 | Murphy et al. | |
| 6,317,920 B1 | | 11/2001 | Brickner et al. | |
| 6,317,921 B1 | | 11/2001 | Park et al. | |
| 6,408,481 B1 | * | 6/2002 | Dyson | 15/350 |

FOREIGN PATENT DOCUMENTS

| | | |
|---|---|---|
| DE | G 82 24 611.4 | 12/1982 |
| DE | G 86 23 004.2 | 12/1986 |
| DE | G 86 07 720.9 | 9/1988 |
| DE | 197 03 014 | 8/1997 |
| EP | 0 401 531 | 10/1994 |

* cited by examiner

*Primary Examiner*—Chris K. Moore
(74) *Attorney, Agent, or Firm*—Harness, Dickey & Pierce, P.L.C.

(57) ABSTRACT

A latching mechanism for an upright vacuum cleaner which allows an upright handle to be quickly and easily detached and reattached to an independently usable powerhead of the vacuum cleaner. The latching mechanism includes a pair of attachment portions formed at a lower end portion of the upright handle which cooperate with a pair of recesses formed in a housing of the powerhead. A foot actuated release lever allows the user to detach the upright handle only when the handle is in an upright orientation. The design of the attachment portions and the recess, in connection with the release lever, prevent the handle from inadvertently being installed backwards on the powerhead, as well as from being inadvertently detached from the powerhead without first depressing the release lever.

13 Claims, 12 Drawing Sheets

FIG. 9.
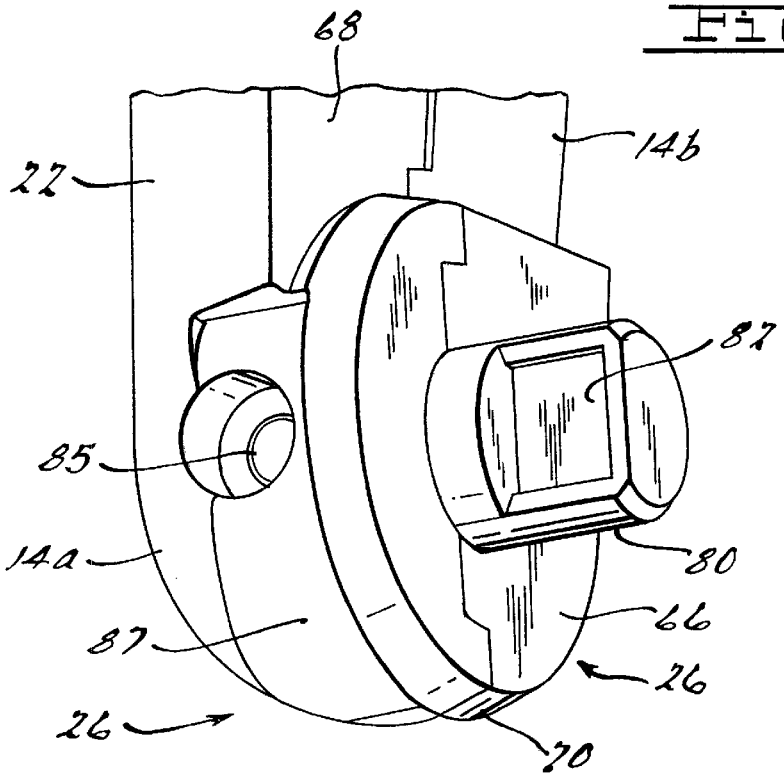
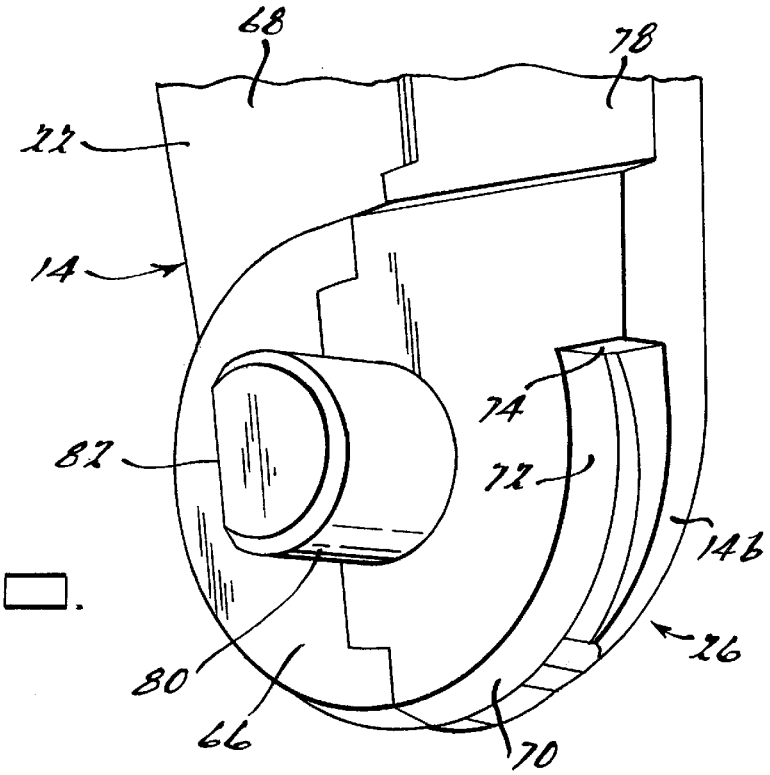
FIG. 10.

FIG. 15.
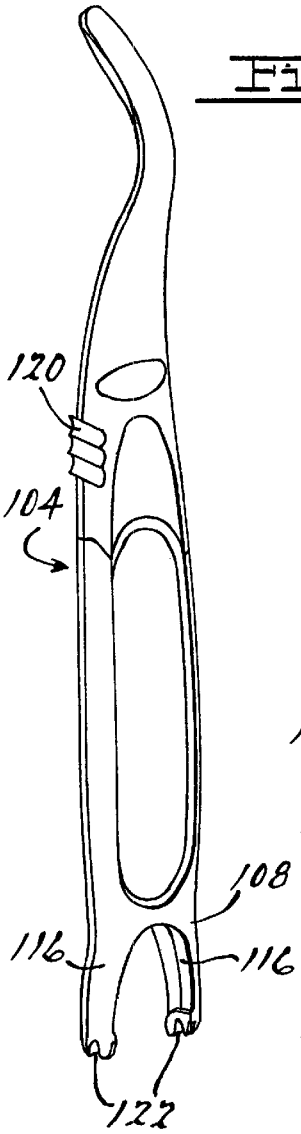
FIG. 16.
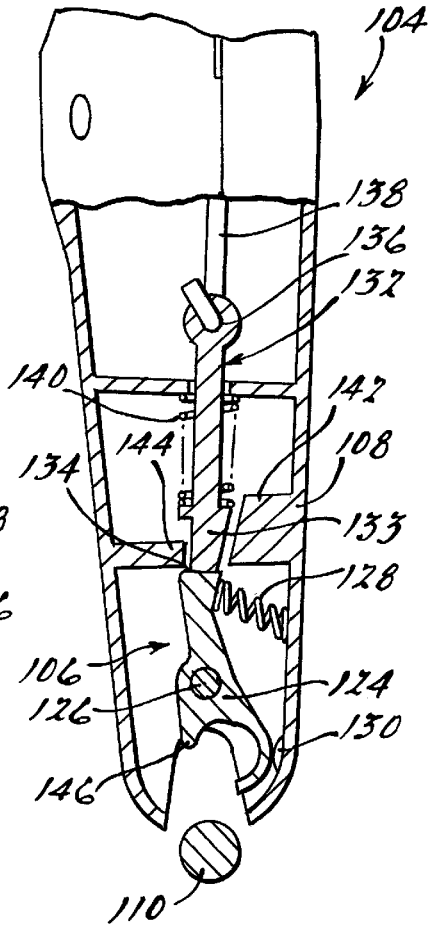
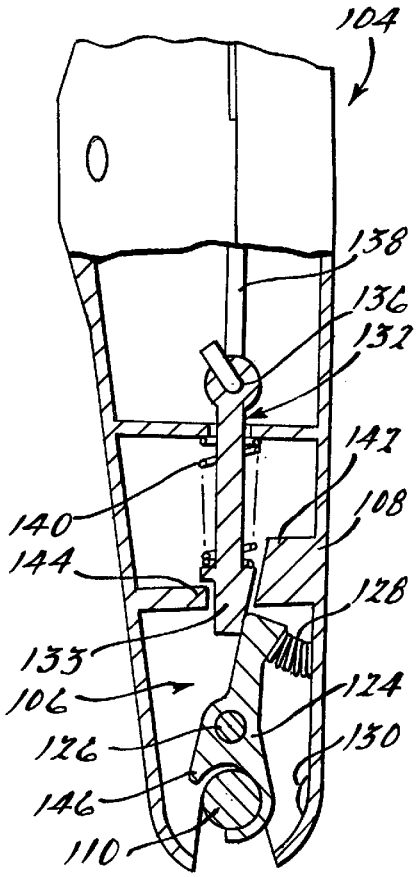
FIG. 17.

UPRIGHT VACUUM CLEANER HAVING DETACHABLE UPRIGHT HANDLE

FIELD OF THE INVENTION

This invention relates to vacuum cleaners, and more particularly to an upright vacuum cleaner having an upright handle which can be readily detached from a powerhead of the vacuum cleaner, and further which includes structure which prevents the handle from being inadvertently attached in a backward orientation on the powerhead.

BACKGROUND OF THE INVENTION

Vacuum cleaner assemblies are used in a wide variety of cleaning applications to clean carpets, upholstered furniture, and other articles. One specific type of upright vacuum cleaner is the "upright" type. This form of vacuum cleaner typically includes a powerhead unit which incorporates a motor for driving a fan. The fan generates a suction airflow for drawing in dust and dirt particles from a surface being cleaned. A filter assembly filters the dust and dirt particles from the ingested airstream. An upright handle is secured to the powerhead for allowing the user to maneuver the powerhead over a work surface when the vacuum cleaner is used in an upright cleaning mode.

In the event the powerhead is capable of being used without the upright handle, such as with a single hand of the user, then it becomes necessary, and desirable, for the upright handle to be easily removed (i.e., detached) from the powerhead. Preferably, such detachment is accomplished without the need for any external tools such as screwdrivers, pliers, etc., which would complicate the process of detaching the handle in addition to adding significant inconvenience for the operator when the handle is to be detached.

Accordingly, for those upright vacuum cleaners having a powerhead intended to be used in some cleaning applications without an upright handle attached to the powerhead, there is a need for a latching mechanism which permits a user to quickly and easily detach an upright handle secured to the powerhead without the need for any external tools, and without the need for complicated disassembly procedures. There is further a need for a latching mechanism which allows an upright handle to be resecured to a powerhead in one quick, easy to perform, motion and without the need for any external tools, and also which prevents the user from damaging the handle and/or the powerhead by coupling the handle to the powerhead in a backward orientation.

SUMMARY OF THE INVENTION

The above and other objects are provided by a vacuum cleaner having an upright handle which includes a latching mechanism in accordance with a preferred embodiment of the present invention. The latching mechanism generally includes an attachment portion formed at a lower end of an upright handle and a cooperating recess formed in a housing of an electric powerhead. Together, the upright handle and the powerhead form an upright vacuum cleaner when the handle is secured to the powerhead.

In one preferred form, the upright handle includes a pair of arms forming a fork. An attachment portion is formed at a lower end of each of the arms. The powerhead includes at least one recess, and more preferably a pair of recesses spaced apart in accordance with the spacing of the attachment portions. The housing of the powerhead also carries a latching arm. In one preferred form the latching arm forms a portion of a foot operated release lever which incorporates a pair of the latching arms spaced apart in accordance with the spacing of the recesses. The latching arms are urged into a latched position, relative to the recesses, by a biasing member.

When the upright handle is to be installed on the powerhead, the user aligns the arms of the handle over the recesses and lowers the attachment portions on each arm into the recesses. As the attachment portions are lowered into the recesses they engage with the latching arms to automatically latch the attachment portions within the recess. In this condition the handle can be moved pivotally relative to the powerhead without being inadvertently detached therefrom.

When it is desired to detach the upright handle from the powerhead, the user merely engages the foot actuated release lever and then, while holding the release lever engaged, lifts up on the upright handle to pull the attachment portions up out of the recesses. Accordingly, no tools or complicated disassembly procedures are required to detach the handle from the powerhead. Attachment and detachment of the handle each occur with a single linear motion of the handle. Advantageously, the attachment portions and the recess include cooperating structure which serves to key the attachment portions to the recesses. This prevents the user from attaching the handle in an incorrect orientation, which in turn helps to alert the user that the handle is incorrectly orientated. In this manner the user will be less apt to try and "force" the handle into engagement with the powerhead when the handle is incorrectly orientated, thus averting possible damage to the handle and/or the powerhead.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 9 is an enlarged front perspective view of one of the attachment portions of the upright handle;

FIG. 10 is an enlarged rear perspective view of the attachment portion of FIG. 9;

FIG. 15 is a perspective view of just the handle of the vacuum cleaner used with the powerhead of FIG. 13;

FIG. 16 is a side cross-sectional view of a portion of a handle incorporating an alternative latching structure adapted to be used with the powerhead of FIG. 13; and FIG. 17 is a view of the handle of FIG. 15 latched to securing post of the powerhead of FIG. 15.

DETAILED DESCRIPTION OF THE PREFERRED EMBODIMENTS

The following description of the preferred embodiment(s) is merely exemplary in nature and is in no way intended to limit the invention, its application, or uses.

Figure 1:
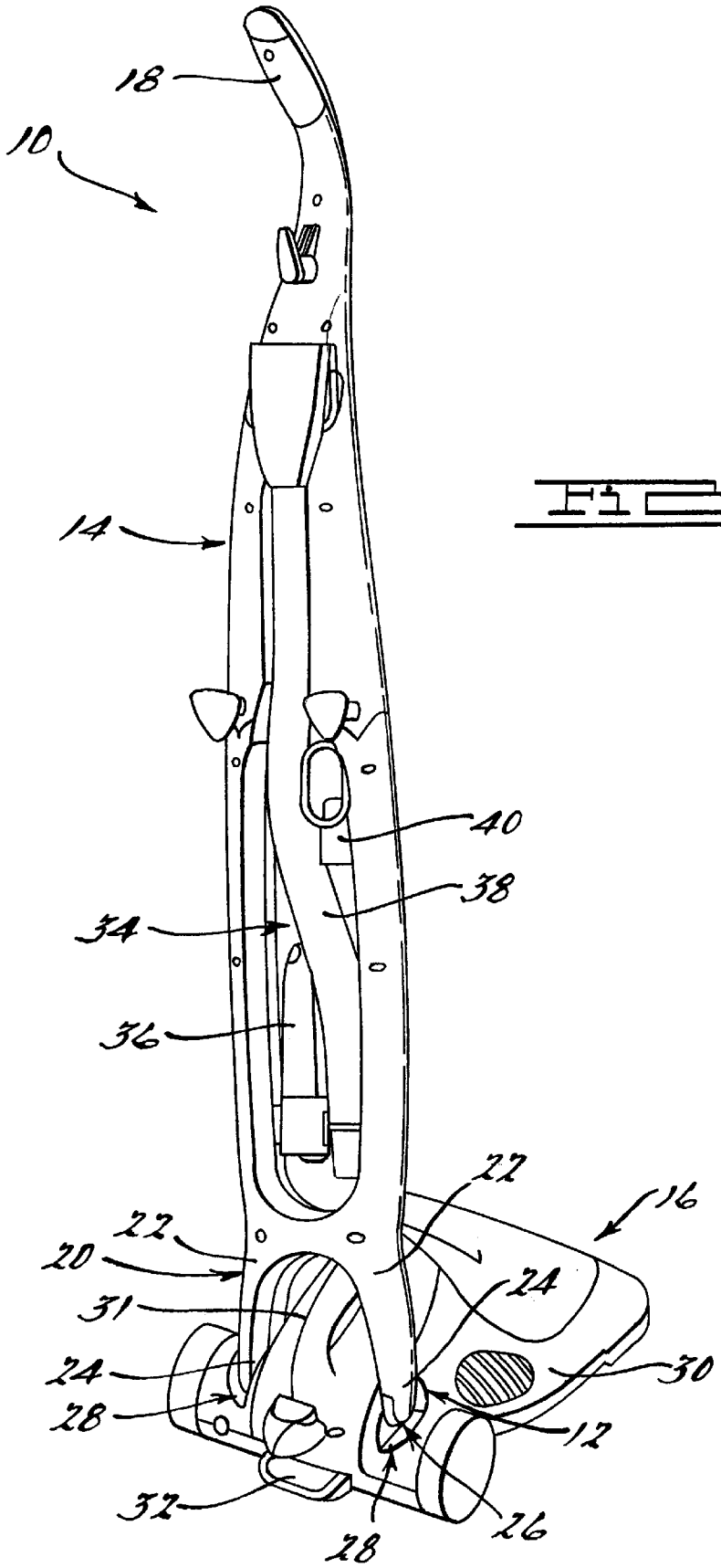
FIG. 1 is a perspective view of a vacuum cleaner incorporating the latching mechanism in accordance with a preferred embodiment of the present invention.
Figure 2:
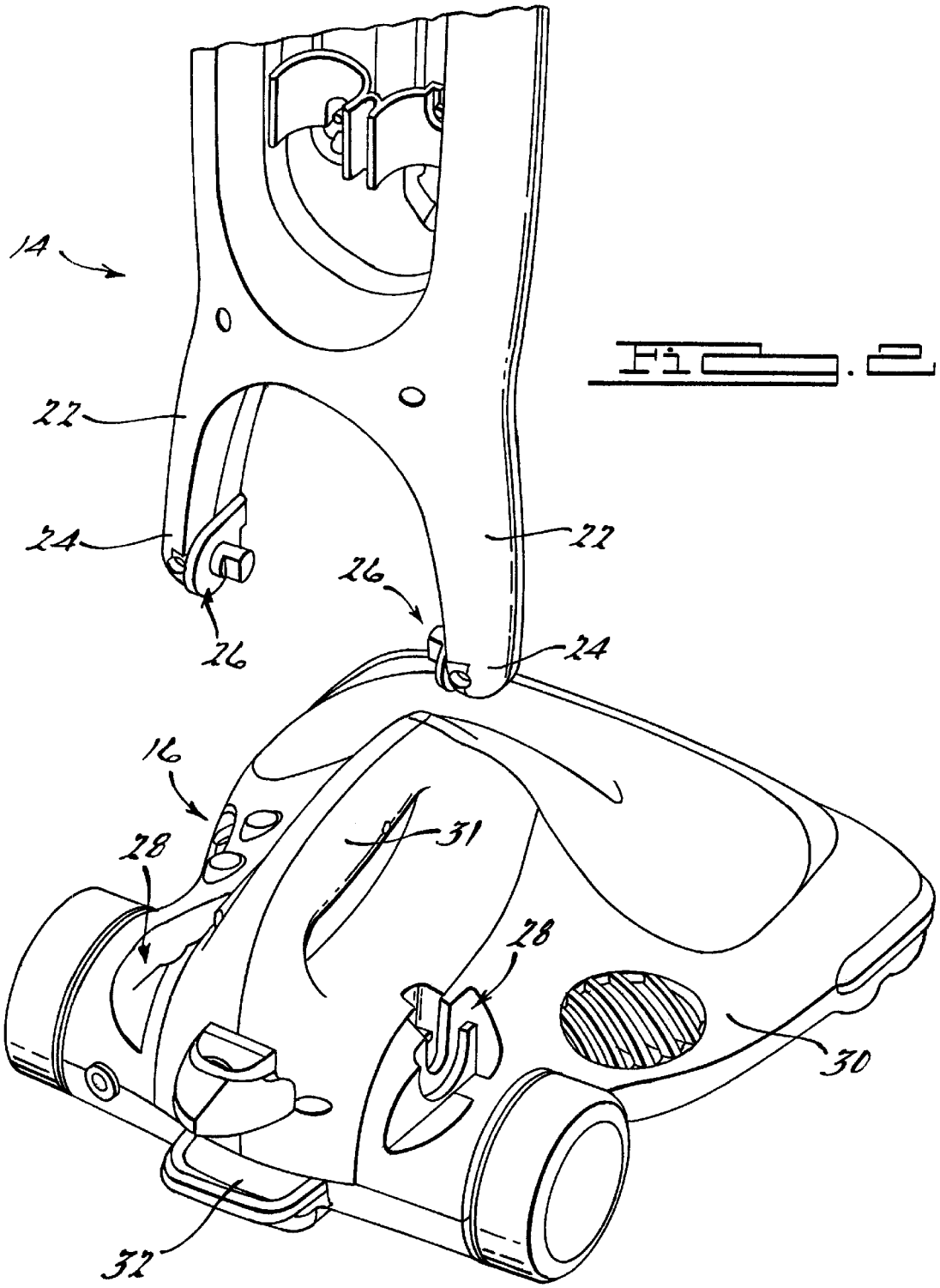
FIG. 2 is a rear perspective view of a portion of the upright handle about to be engaged with the powerhead, and illustrating the handle correctly orientated or insertion into the recesses in the powerhead.
Figure 3:
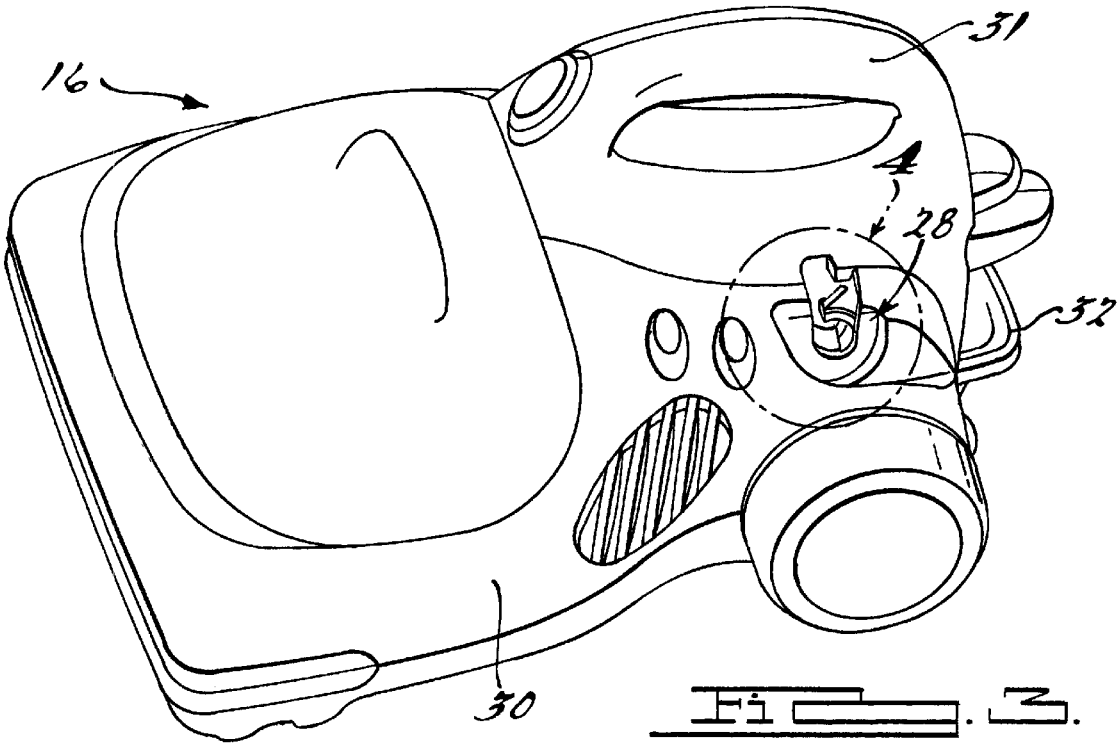
FIG. 3 is a side perspective view of the powerhead illustrating one of the recesses.

Referring to FIGS. 1 and 2, there is shown a vacuum cleaner 10 incorporating a latching mechanism 12 in accordance with a preferred embodiment of the present invention. The vacuum cleaner 10 generally includes an upright handle assembly 14 and a powerhead 16. The handle 14 includes an upper handle portion 18 and a lower end 20. The lower end 20 includes a pair of arm portions 22 forming a "fork". Lowermost ends 24 of each arm portion 22 include an attachment portion 26. Attachment portions 26 engage within a pair of recesses 28 formed in a housing 30 of the powerhead 16. The attachment portions 26, in cooperation with the recesses 28, form two components of the latching mechanism 12 and enable the handle 14 to be detachably secured to the powerhead 16. Thus, when the vacuum cleaner 10 is to be used in an upright cleaning mode, the handle 14 is attached to the powerhead, as shown in FIG. 1, to allow the user to maneuver the powerhead 16 over a surface being cleaned.

It will be appreciated that the attachment portions 26 could just as easily be formed on the powerhead 16 and the recesses formed at the arm portions 22. Alternatively, as will be described more fully in the following paragraphs, the majority of the components of the latching mechanism 12 may be carried on the handle 14.

The powerhead 16 also can be used apart from the handle 14 as an independent cleaning tool to clean areas such as stairs, within closets, and other like areas where maneuvering of the powerhead 16 via the handle 14 would be awkward or impossible. To this end, the housing 30 of the powerhead 16 incorporates an integrally formed handle 31 for allowing the user to maneuver the powerhead 16 with a single hand over a surface being cleaned. To allow the powerhead 16 to be used without the handle 14, the housing also incorporates a foot actuated release lever 32. The release lever 32 forms the third component of the latching mechanism 12 and will be described more fully in the following paragraphs. Briefly, however, engaging the release lever 32 allows the handle 14 to be quickly and easily detached from the powerhead 16 without the need for any external tools, and also without the need for complicated disassembly procedures.

Referring further to FIG. 1, the upright handle 14 is also shown as incorporating a tool supporting area 34 for holding a plurality of cleaning attachments. Such cleaning attachments may include a crevice cleaning tool 36, an auxiliary hose length 38 and a brush attachment 40. While these components are not essential to the operation of the latching mechanism 12, they have been illustrated to further highlight that the latching mechanism 12 does not interfere with, or limit, the use of the handle 14 in supporting such well known cleaning attachments.

Referring to FIGS. 2–5, the recesses 28 in the housing 30 of the powerhead 16 can be seen in greater detail. Each recess 28 includes an arcuate shoulder 42 which receives the attachment portion 26 at the end of each arm portion 22 of the upright handle 14. An opening 44 allows part of the attachment portion 26, to be described momentarily, to project transversely into the housing. An upper shoulder 46 cooperates with its associated attachment portion 26 to limit forward movement of the handle 14 to essentially the position shown in FIG. 1.

Figure 6:
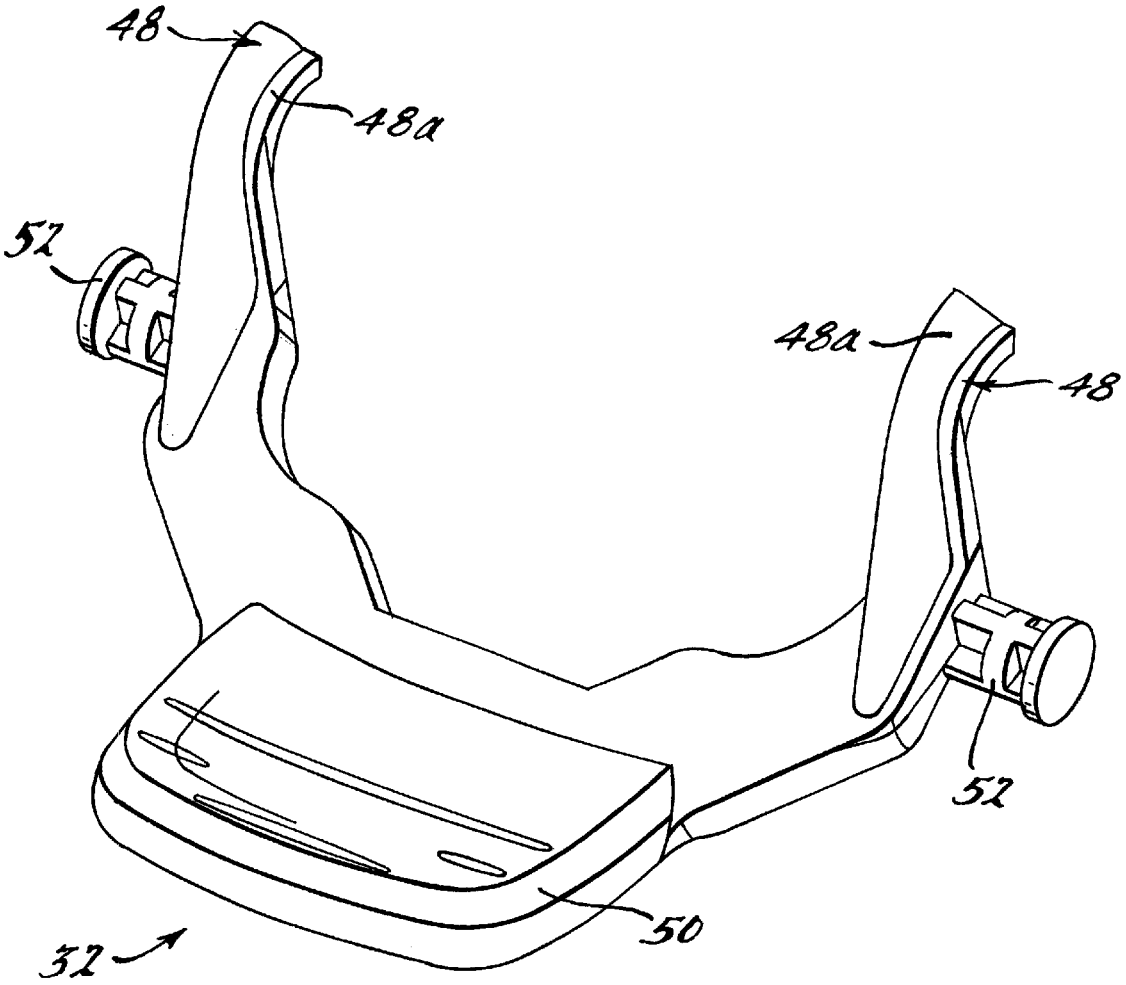
FIG. 6 is a perspective view of the foot actuated release lever.
Figure 7:
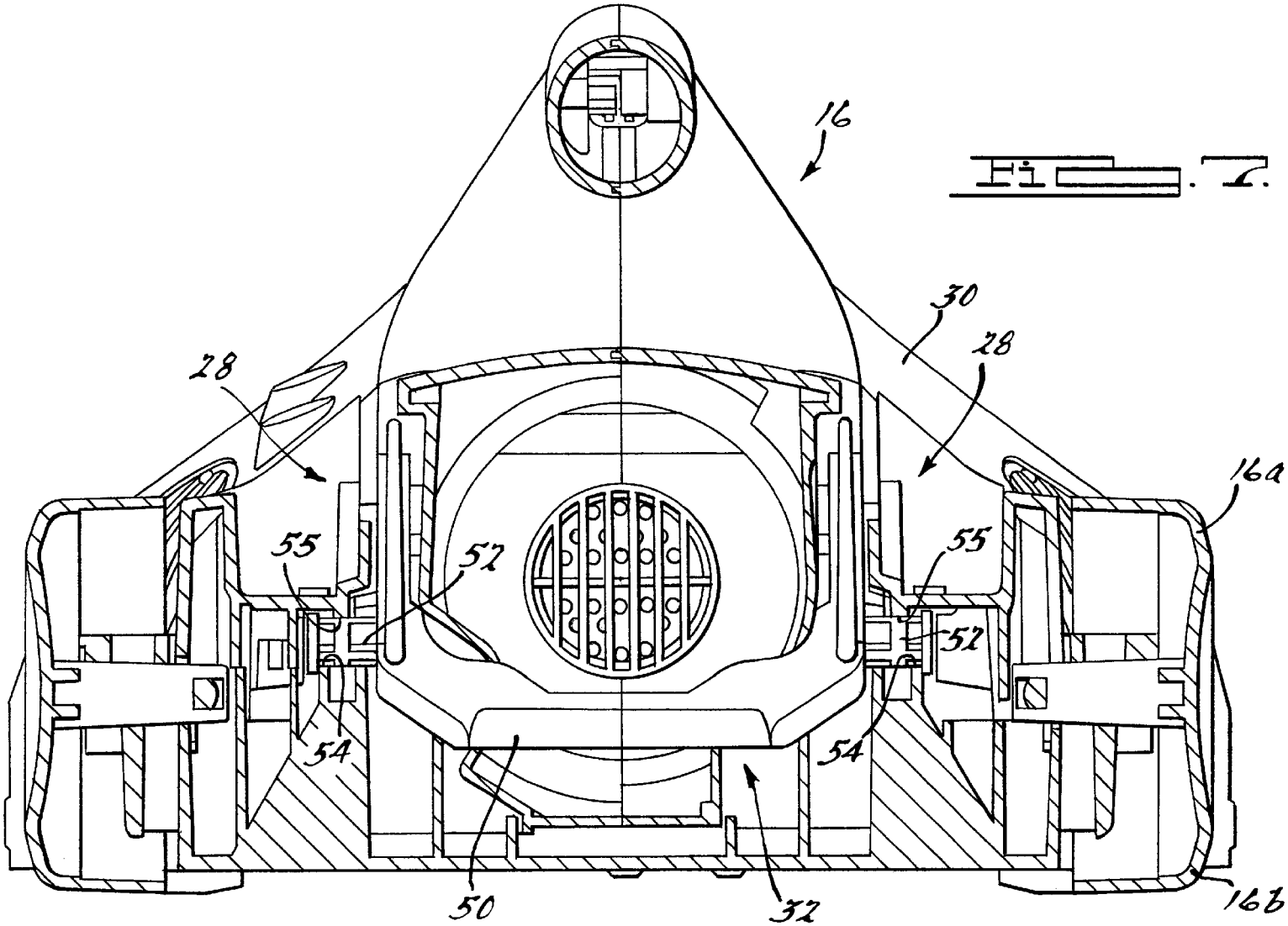
FIG. 7 is a cross-sectional view of the powerhead taken in accordance with section line 7—7 in FIG. 5.

Referring to FIGS. 6 and 7, the foot actuated release lever 32 and its mounting within the powerhead 16 can be seen in greater detail. The release lever 32 includes a pair of spaced apart latching arms 48 depending from a foot pedal portion 50. A mounting post 52 projects transversely of each latching arm 48. Each latching arm 48 has an arcuate profile for engaging with a portion of its associated attachment portion 26.

Referring specifically to FIG. 7, the housing 30 of the powerhead 16 can be seen to include a pair of internal support surfaces 54 and 55 for supporting the mounting post 52 for rotational movement. The housing 16 is comprised of an upper housing section 16*a,* a lower housing section 16*b,* and the release lever 32 is between the support surfaces 54 and 55 of the housing sections 16*b* and 16*a,* respectively, of the lower housing section 16*b* during assembly of the powerhead 16. When the upper housing section 16*a* is assembled to the lower housing section 16*b,* the mounting posts 52 are trapped between the support surfaces 54 and 55 but permit rotational movement of the mounting posts 52.

Figure 8:
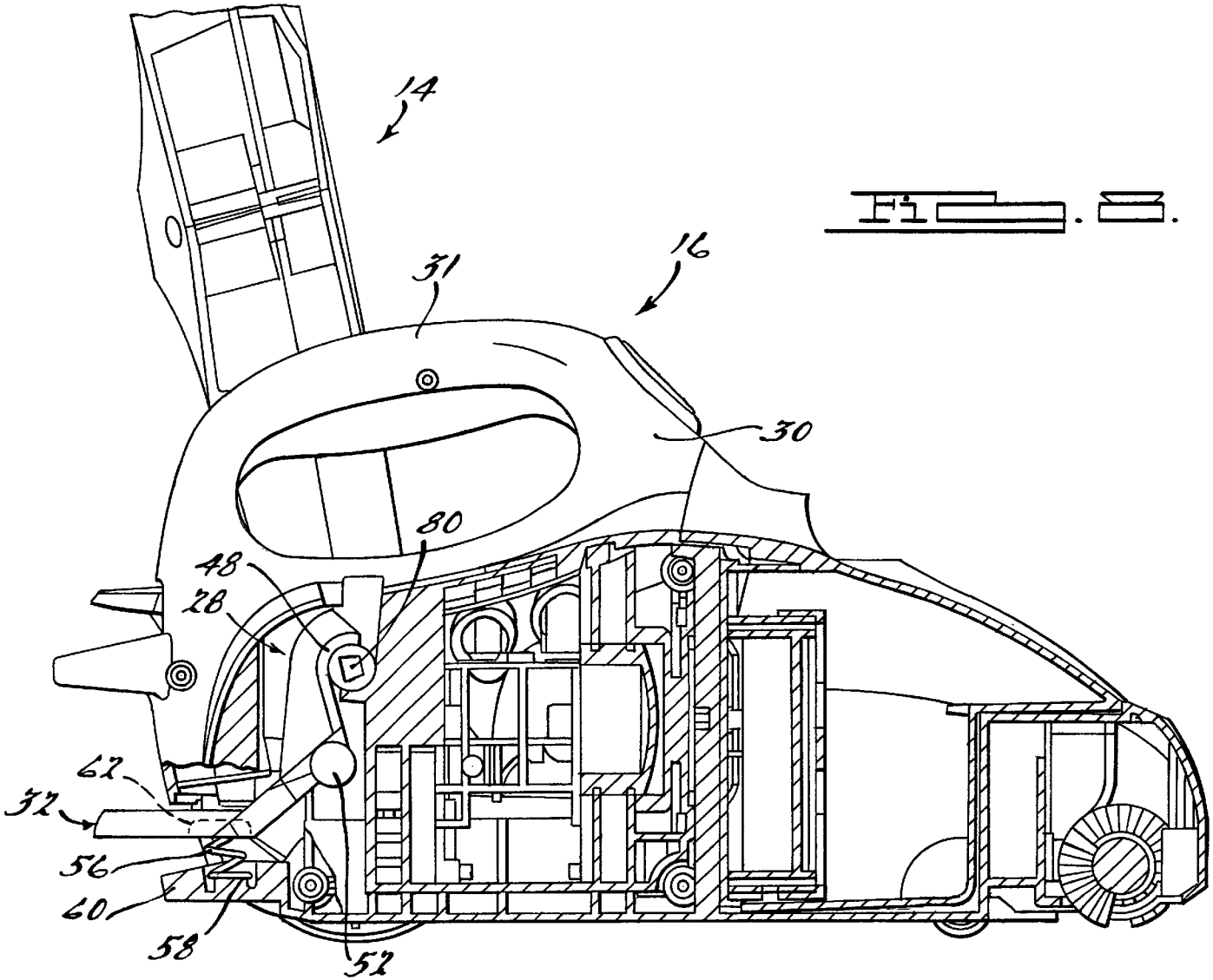
FIG. 8 is a side cross-sectional view of the powerhead taken in accordance with section line 8—8 in FIG. 5, showing the upright handle correctly engaged with the recess of the powerhead.

With reference to FIG. 8, the housing 30 can also be seen to include a coil spring 56 supported within a recess 58 of a release lever stop member 60. The release lever stop member 60 limits downward movement of the release lever 32. The coil spring 56 provides a continuous biasing force to maintain the release lever 32 in its latched position as shown in FIG. 8. An upper end of the coil spring 56 rests within a pocket 62 so that the upper end cannot shift laterally when the release lever 32 is depressed or released.

Referring now to FIG. 9, one of the attachment portions 26 can be seen. Each attachment portion 26 includes a circumferential base portion 66 which projects outwardly slightly of a lowermost area 68 of the arm portion 22. The base portion 66 has a beveled edge 70 and forms a notch 72 near its upper distal end. The notch 72 has a flat surface 74 which limits forward pivoting movement of the handle 14 to the position shown in FIG. 1.

With further reference to FIGS. 9 and 10, the base portion 26 further includes a generally D-shaped mounting post 80 projecting transversely thereof. The "D" shape is formed by a flat surface 82 on the mounting post 80 which faces rearwardly (as shown in FIG. 8) when the handle 14 is installed on the powerhead 16. The handle 14 is a two-piece, clamshell-like construction which comprises sections 14*a* and 14*b*. An opening 85 is formed in a peripheral edge 87 of section 14*a* to accommodate a fastener, such as a threaded screw, which engages within a blind hole (not shown) in section 14*b* to help hold the two sections together.

Figure 4:
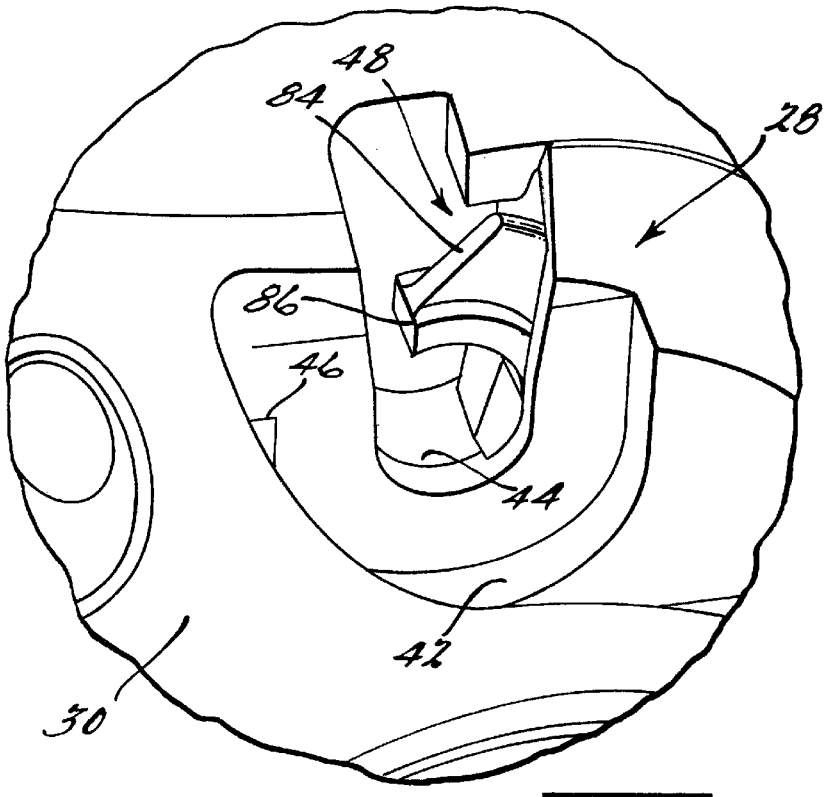
FIG. 4 is an enlarged perspective view of circled area 4 in FIG. 3 showing the recess in greater detail.
Figure 5:
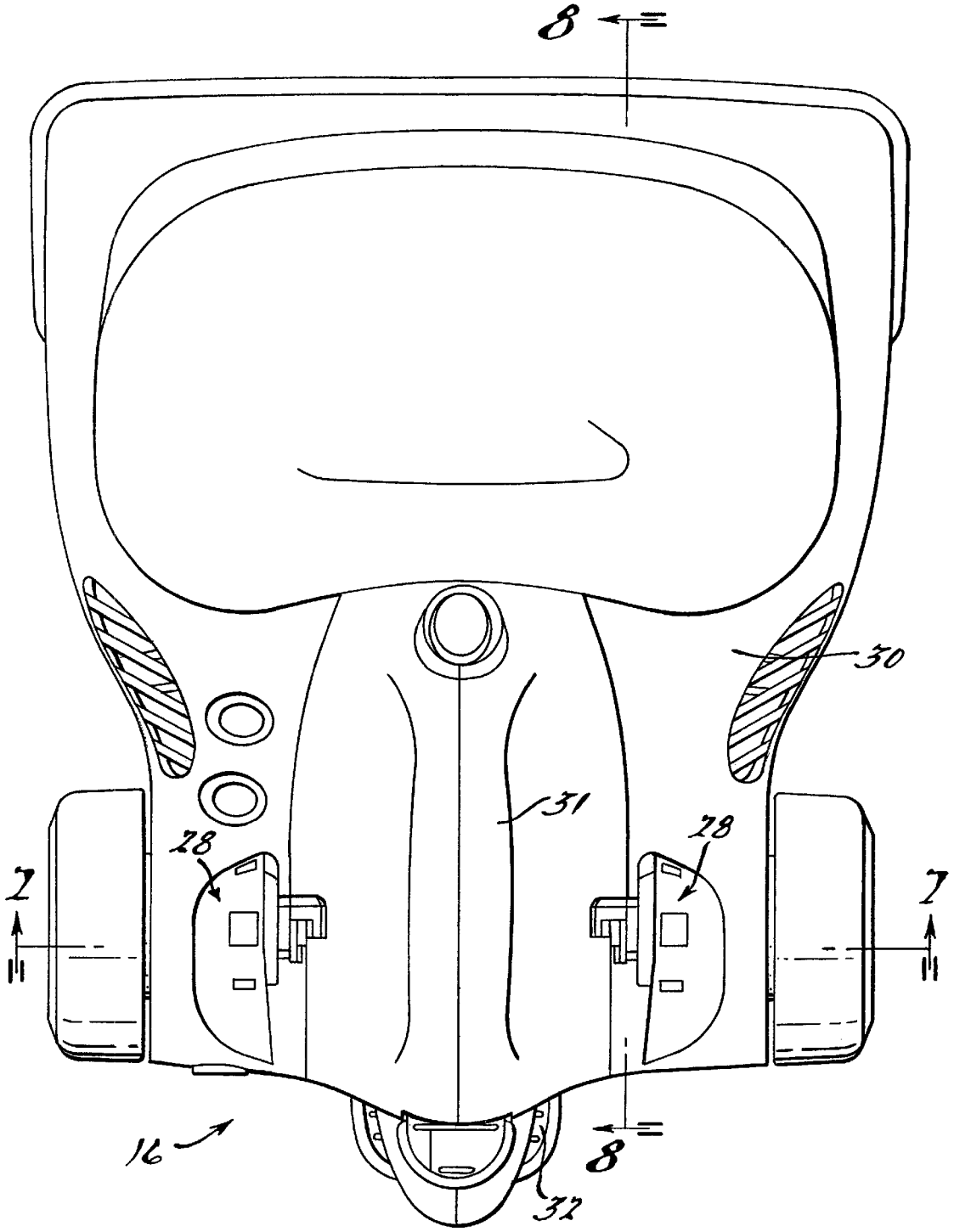
FIG. 5 is a plan view of just the powerhead.
Figure 11:
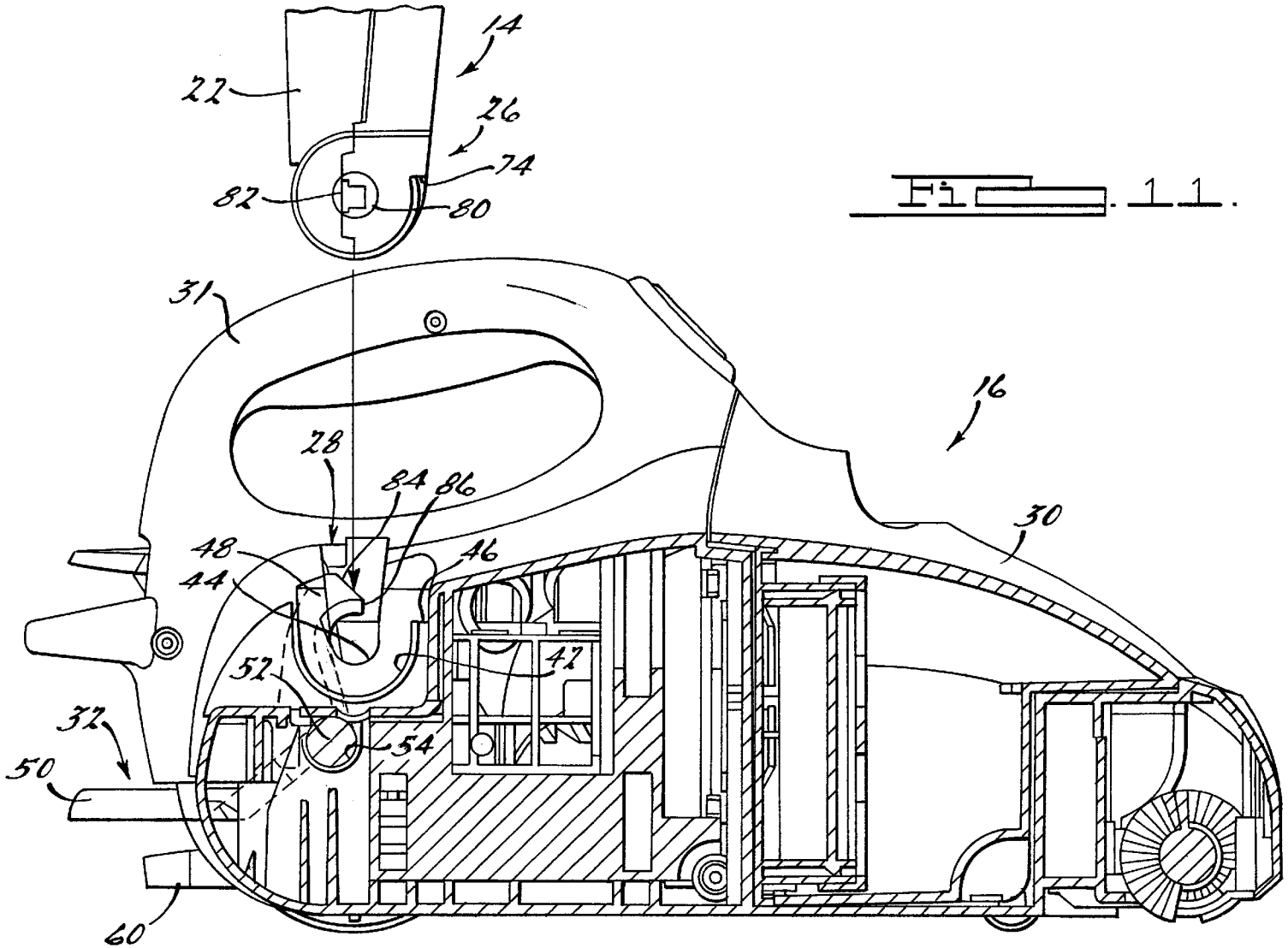
FIG. 11 is a side cross-section view of the powerhead with the upright handle orientated correctly for insertion in the recess, and about to be lowered into the recess.

With further reference to FIGS. 4, 10 and 11, the mounting post 82 of each attachment portion 26 seats within an associated one of the openings 44 and the recesses 28 when the handle 14 is correctly installed in the recesses 28. The D shape of the mounting posts 80 ensures this, preventing the mounting posts 80 from being fully seated within the openings 44 if the handle 14 is orientated 180° from its correct orientation.

Referring now to FIGS. 8 and 11, when the handle 14 is to be attached to the powerhead 16, and is orientated correctly (i.e., with flat surfaces 82 facing rearwardly) as shown in FIG. 11, the attachment portion 26 at the lower end of each arm 22 may be dropped into its associated recess 28 and the mounting post 80 will abut a tapered edge 84 of a rib 86 of the latching arm. As the handle 14 is lowered further, the mounting post 80 will urge the latching arm 48 counterclockwise in the drawing of FIG. 11. As the mounting post 80 is lowered further and completely clears the latching arm 48, the latching arm will be urged by the biasing spring 56 (FIG. 8) clockwise to latch over the mounting post 80. At this point the handle 14 will not be removable from the powerhead 16 unless the release lever 32 is depressed into engagement against the stop member 60. Thus, attachment of the handle 14 to the powerhead 16 does not require the user to depress the release lever 32, but releasing of the handle 14 does require such a depressing of the release lever before the handle can be lifted up and detached from the powerhead 16.

Figure 12:
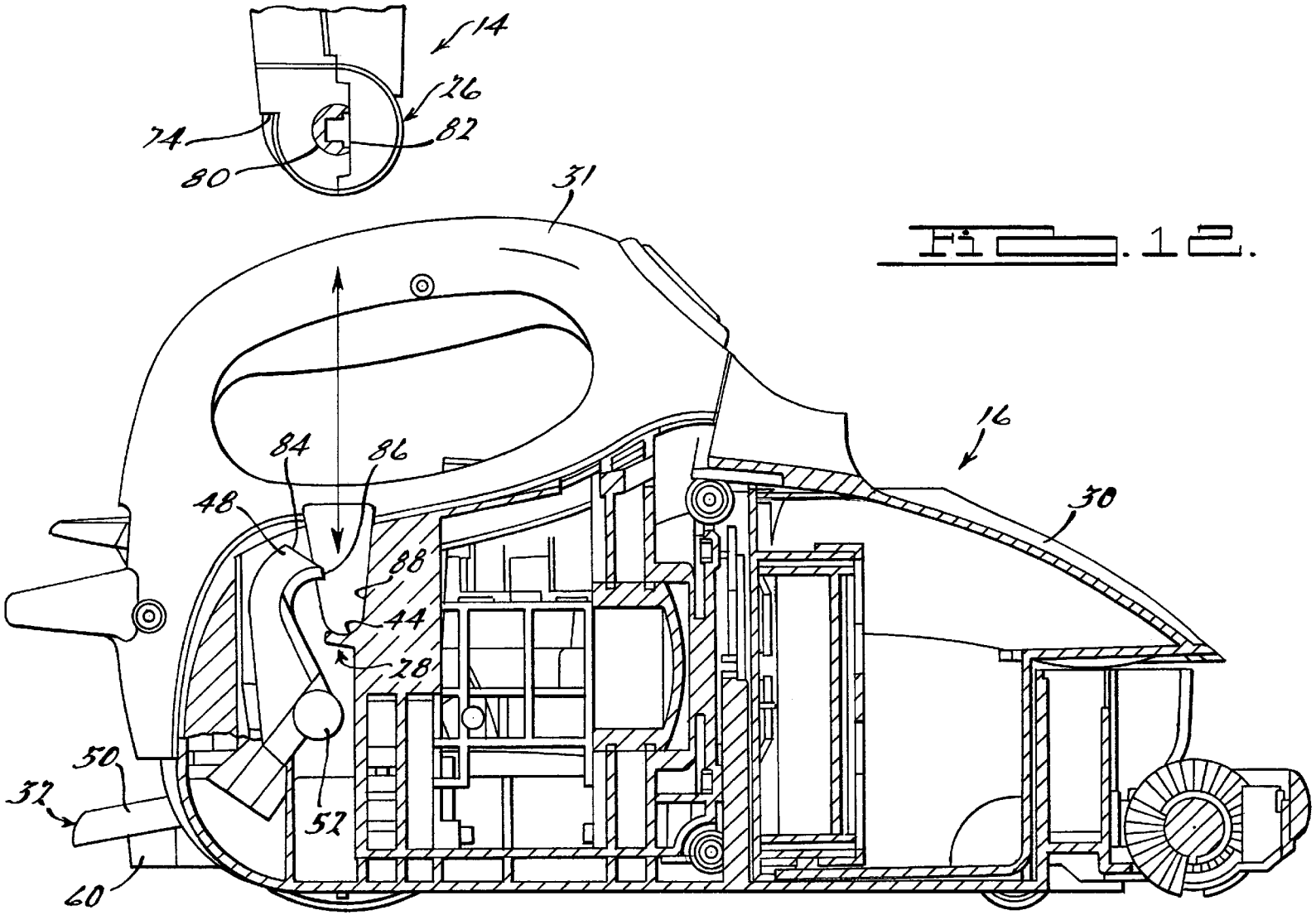
FIG. 12 is a view of the powerhead of FIG. 11 but with the upright handle orientated incorrectly (i.e., 180 degrees turned, or backwards) from the orientation it needs to be to be inserted and latched to the powerhead.
Figure 13:
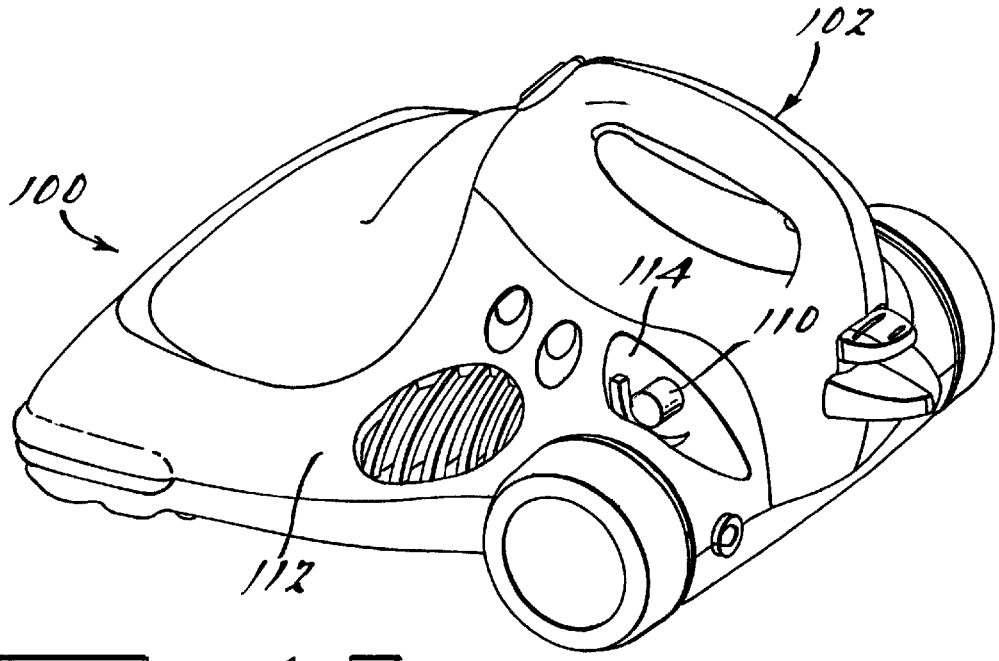
FIG. 13 is a right-hand perspective view of a powerhead adapted for use with an alternative preferred latching mechanism of the present invention.
Figure 14:
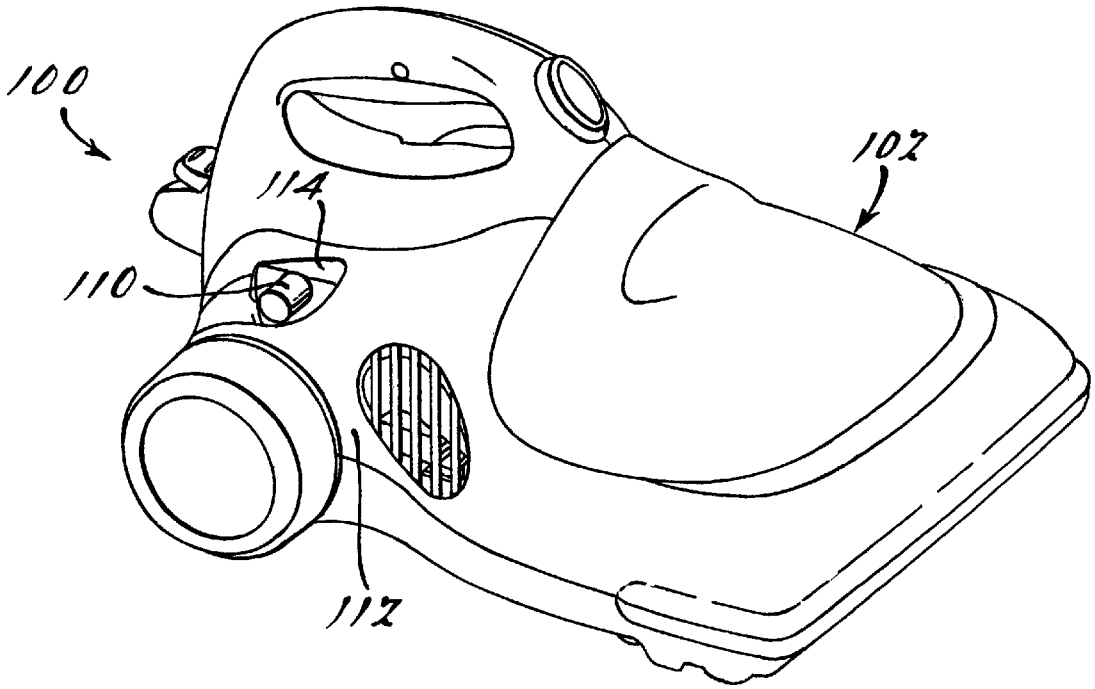
FIG. 14 is a left-hand perspective view of the powerhead of FIG. 13.

It is an important feature of the present invention that the flat surface 82 only permits the attachment portions 26 of the handle 14 to be fully inserted in the recesses 28 when the handle 14 is correctly orientated. If the handle is incorrectly orientated, meaning that the flat surfaces 82 of the mounting posts 80 are facing forwardly as shown in FIG. 12, then the mounting posts will not be able to properly latch within the recesses 28. This is because even with the release lever 32 urged into its fully counterclockwise most position, as shown in FIG. 11, there will not be sufficient clearance between a forwardmost edge 86 of the latching arm 48 and a wall portion 88 (FIG. 11) in the housing 30 to permit the mounting post 80 to clear the forwardmost edge 86 of the latching arm. Thus, the user would be instantly apprised that the handle 14 is not in the correct orientation because the attachment portions 26 will not be able to be latched in the recesses 28.

The circumferential shape of the base portion 66 provides further advantage that it prevents the attachment portions 26 from being inadvertently lifted out of the recesses 28 when the handle 14 is in use, and therefore not in a perfectly upright orientation. Therefore, as an example, when the handle is in the position shown in FIG. 8, even if the release lever 32 is depressed, there will not be sufficient clearance between the forwardmost edge 86 of the latching arm 48 and the interior wall portion 88 to allow the mounting post 80 to be lifted past the forwardmost edge of the latching arm. Thus, to remove the handle 14 the user must first place the handle in the upright orientation shown in FIGS. 1 and 11, then depress the release pedal 32, and then lift upwardly on the handle 14.

Referring now to FIGS. 13–17, a vacuum cleaner 100 in accordance with an alternative preferred embodiment of the present invention is shown. The vacuum cleaner 100 is comprised of a powerhead 102 and a detachable upright handle 104. A latching mechanism 106 is carried by a lower end 108 of the handle 104 rather than by the powerhead 102, in contrast to the vacuum cleaner 10 of FIG. 1. A pair of mounting posts 110 formed on a housing 112 adjacent recesses 114 on the housing 112 operate in cooperation with the latching mechanism 106, which is disposed within each arm 116 at the lower end 108 of the handle 104.

Referring specifically to FIG. 15, a hand actuatable release member 120 is mounted on the handle 104. The release member 120 is moveable up and down. The lower end 108 of the handle 104 also includes a V-shaped groove 122 at each arm 116.

With reference to FIGS. 16 and 17, one of the latching mechanisms 106 can be seen. The latching mechanism 106 includes a latching lever 124 that is pivotally mounted on a boss portion 126 and spring biased toward a release position (as shown in FIG. 16) by a spring 128. A stop member 130 limits rotational movement of the latching lever 124 in the counterclockwise direction.

With further reference to FIGS. 16 and 17, a slider 132 has a head portion 133 which rests on an upper surface 134 of the latching lever 124. An upper end of the slider 132 includes an opening 136 which is coupled to a cable 138. The opposite end of the cable 138 is coupled to the release member 120. A spring 140 biases the slider 132 downwardly in the drawing of FIGS. 16 and 17. The head portion 133 of the slider 132 is guided between internal walls 142 and 144 of the handle 104 during vertical movement.

When the handle 104 is to be latched to the mounting posts 110 of the powerhead 102, the user positions the lower end 108 of the handle such that the V-shaped grooves 122 are over the mounting posts. The user then lowers the handle 104 and a thumb portion 146 of each latching lever 124 contacts its associated mounting post 110. As the handle 104 is lowered further, the latching lever 124 is urged clockwise against the biasing force of spring 128 as the latching lever fully engages its associated mounting post 110. As this movement occurs, the upper surface 134 of the latching lever 124 moves laterally of the head portion 133 of the slider 132, which allows the head portion to be urged by the spring 140 down into the position shown in FIG. 17. In this position the latching lever 124 is latched to the mounting post 110 but can still be rotated around the mounting post.

To detach the handle 104, the user lifts up on the release member 120 which lifts the slider up against the biasing force of spring 140 into the position shown in FIG. 16. As soon as the head portion 133 clears the upper end of the latching lever 124, the spring 128 urges the latching lever 124 counterclockwise into the position shown in FIG. 16. The latching lever 124 will be held in this position after the user releases the release member 120.

The latching mechanism of the present invention thus provides a convenient and easy to operate means for allowing a user to quickly and easily attach and detach the upright handle from the powerhead when needed. Importantly, no external tools or complicated disassembly or reassembly procedures are required. The latching of the handle to the powerhead is further accomplished with a minimum number of additional component parts being required within the powerhead. Thus, the latching mechanism does not add significantly to the weight or cost of the vacuum cleaner nor require modifications to the suction airflow path within the powerhead.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A vacuum cleaner comprising:

a powerhead for generating a suction airflow;

said powerhead having a first securing structure for engaging with a portion of a detachable handle;

a detachable upright handle for maneuvering said powerhead over a surface being cleaned, said upright handle having a second securing structure for automatically engaging within said first securing structure when said handle portion is attached to said powerhead;

a release member associated with one of said securing structures and manually engageable by a user;

a biasing element for biasing said release member into a normally latched position; and wherein said second securing structure can be released from said first securing structure by movement of said release member to permit said upright handle to be detached from said powerhead by engaging said release member and separating said upright handle from said powerhead.

2. The vacuum cleaner of claim 1, wherein said first securing structure comprises a recess formed in said powerhead and said release member.

3. The vacuum cleaner of claim 1, wherein said second securing structure comprises an attachment portion formed at a lower end of said upright handle, and wherein said release member is associated with said first securing structure to engage said attachment portion when said upright handle is secured to said powerhead.

4. The vacuum cleaner of claim 3, wherein said release member is pivotally mounted on said powerhead such that a portion of said release member projects from said powerhead and is readily engageable by said user; and wherein a portion of said release member automatically engages said attachment portion when said lower end of said upright handle is urged into engagement with said release member.

5. A vacuum cleaner comprising:

a powerhead for generating a suction airflow;

said powerhead having at least one recess formed in a housing thereof and a manually engageable release lever, said release lever being supported from said housing and biased via a biasing force toward a latched position, and movable against said biasing force to an open position;

an upright handle for maneuvering said powerhead over a surface being cleaned, said upright handle having a lower end including an attachment portion, said attachment portion including a securing portion for automatically engaging within said recess when said attachment portion is lowered into said recess;

wherein said securing portion can be released from said recess by manual movement of said release lever to permit said upright handle to be detached from said powerhead; and wherein said attachment portion includes structure keying it to said recess such that said upright handle cannot be installed in a backward orientation by a user.

6. The vacuum cleaner of claim 5, wherein said release lever includes a latching arm having an angled upper surface for engaging with said securing portion when said attachment portion is lowered into said recess and urging said release lever away from said recess, to thereby permit said latching arm to automatically engage said securing portion when said securing portion is fully seated within said recess.

7. The vacuum cleaner of claim 6, wherein said attachment portion includes a rib, and wherein said recess comprises a shoulder for interfering with rib to prevent said upright handle from being inadvertently installed in a backward orientation on said powerhead by a user.

8. A vacuum cleaner comprising:

a powerhead for generating a suction airflow;

said powerhead having at least one recess formed in a housing thereof and a foot actuated lever having a latching arm, said lever being pivotally supported from said housing and biased toward a latched position, and movable against said biasing force to an open position;

an upright handle having a lower end including an attachment portion, said attachment portion including a securing post for engaging within said recess; and wherein said securing post is automatically engageable with said latching arm in said latched position within said recess when said attachment portion is lowered into said recess; and wherein said securing post is released from said powerhead when said toot actuated lever is engaged by a user, thereby removing said latching arm from engagement with said securing post.

9. The vacuum cleaner of claim 8, wherein said securing post comprises structure keying it to said recess such that said handle is prevented from being secured to said powerhead in a backwards orientation.

10. The vacuum cleaner of claim 9, wherein said attachment portion comprises a raised shoulder, and wherein said raised shoulder interferes with a portion of said recess if said handle is inserted in said backward orientation to prevent latching of said attachment portion within said recess.

11. The vacuum cleaner of claim 8, wherein said latching arm includes an angled upper surface for enabling said attachment portion to automatically urge said latching arm away from said recess as said attachment portion contacts said angled upper surface while being lowered into said recess.

12. A vacuum cleaner comprising:

a powerhead for generating a suction airflow;

said powerhead having at least one recess formed in a housing thereof and a foot actuated lever having a latching arm, said lever being pivotally supported from said housing;

a biasing member for biasing said foot actuated lever toward a latched position, said lever being movable against said biasing force to an unlatched position;

an upright handle having a lower end including an attachment portion, said attachment portion including a securing post for engaging within said recess;

said securing post being automatically engageable with said latching arm in said latched position within said recess when said attachment portion is lowered into said recess;

said securing post being released from said powerhead when said foot actuated lever is engaged by a user, thereby removing said latching arm from engagement with said securing post; and said attachment portion and said recess including cooperating structure to key said attachment portion to said recess such that said upright handle cannot be inadvertently installed in a backward orientation on said powerhead.

13. The vacuum cleaner of claim 12, wherein said latching arm includes an angled upper end which enables said attachment portion to contact and urge said latching arm away from said recess as said attachment portion is lowered into said recess, whereupon said latching arm snaps into latching engagement with said securing portion when said attachment portion is substantially fully seated within said recess.

* * * * *